US006983696B2

(12) United States Patent
Koch et al.

(10) Patent No.: US 6,983,696 B2
(45) Date of Patent: Jan. 10, 2006

(54) APPARATUS FOR COOLING MATERIAL TO BE PRINTED AND PRINTING UNITS AT SHEET FED PRINTING MACHINES WITH COOLED COMPRESSED AIR

(75) Inventors: Michael Koch, Cossebaude (DE); Tilo Steinborn, Meissen (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 10/273,198

(22) Filed: Oct. 17, 2002

(65) Prior Publication Data

US 2003/0121440 A1 Jul. 3, 2003

(30) Foreign Application Priority Data

Oct. 24, 2001 (DE) ..... 101 52 593

(51) Int. Cl.
*B41F 23/04* (2006.01)

(52) U.S. Cl. ..... 101/487; 101/232; 101/233; 101/416.1; 101/419

(58) Field of Classification Search ..... 101/487, 101/232, 233, 416.1, 419
See application file for complete search history.

(56) References Cited

U.S. PATENT DOCUMENTS 3,900,959 A * 8/1975 Breschi et al. ..... 34/639
4,479,645 A * 10/1984 Pollich ..... 271/183
4,727,385 A * 2/1988 Nishikawa et al. ..... 347/152
4,811,493 A * 3/1989 Burgio, Jr. ..... 34/268
5,178,064 A * 1/1993 Kerber et al. ..... 101/130
5,375,518 A * 12/1994 Kurz ..... 101/216
5,452,657 A * 9/1995 Kurz ..... 101/216
5,497,987 A * 3/1996 Henn et al. ..... 271/204
5,588,360 A 12/1996 Kurz
5,595,115 A 1/1997 Rau et al.
5,669,603 A * 9/1997 Detmers et al. ..... 271/183
5,784,957 A 7/1998 Rau et al.
5,816,155 A * 10/1998 Stephan ..... 101/232
5,931,093 A * 8/1999 Walther et al. ..... 101/232
5,979,325 A * 11/1999 Mitze et al. ..... 101/488
5,992,845 A 11/1999 Fendler et al.
6,000,695 A * 12/1999 Mack et al. ..... 271/303
6,378,425 B1 * 4/2002 Stephan ..... 101/232
6,416,051 B1 * 7/2002 Autz ..... 271/195
6,662,722 B2 * 12/2003 Frankenberger et al. .... 101/232

FOREIGN PATENT DOCUMENTS

DE G 92 14 459.4 U1 3/1993
DE 42 02 544 A1 8/1993
DE G 93 10 028.0 U1 12/1993

(Continued)

*Primary Examiner*—Ren Yan
*Assistant Examiner*—Andrea H. Evans
(74) *Attorney, Agent, or Firm*—Goodwin Procter, LLP

(57) ABSTRACT

The present invention relates to an apparatus for cooling material to be printed and printing machine elements at sheet-fed rotary printing machines by means of cooled compressed air. It is an object of the present invention to provide an apparatus which requires little space, is able to cool effectively the material to be printed as well as the machine elements, which are undesirably heated by the dryers. Pursuant to the present invention, this objective is accomplished by providing an apparatus wherein cooled, compressed air is supplied over one or more sheet-guiding devices for guiding the sheets pneumatically along the sheet-guiding path, and a cooling device is disposed in the cross section of flow of the compressed air or the sheet-guiding device.

12 Claims, 3 Drawing Sheets

FOREIGN PATENT DOCUMENTS

| | | | |
|---|---|---|---|
| DE | 43 26 835 | A1 | 2/1995 |
| DE | 195 21 442 | A1 | 5/1996 |
| DE | 196 51 406 | C1 | 6/1998 |
| DE | 198 10 387 | C1 | 7/1999 |
| DE | 198 42 740 | A1 | 3/2000 |
| DE | 298 24 606 | U1 | 11/2001 |
| DE | 195 13 426 | C2 | 7/2002 |
| DE | 197 16 424 | B4 | 8/2004 |
| EP | 0 246 100 | A2 | 11/1987 |
| EP | 0 480 230 | A1 | 4/1992 |
| EP | 0 652 104 | B1 | 5/1995 |
| EP | 0 987 206 | A2 | 4/1999 |
| GB | 2276150 | A | 9/1994 |
| WO | WO 01/32423 | A1 | 5/2001 |

* cited by examiner

APPARATUS FOR COOLING MATERIAL TO BE PRINTED AND PRINTING UNITS AT SHEET FED PRINTING MACHINES WITH COOLED COMPRESSED AIR

FIELD OF THE INVENTION

The present invention relates to an apparatus for cooling materials to be printed and printing machine elements at sheet-fed rotary printing machines by means of cooled compressed air.

BACKGROUND OF THE INVENTION

It is generally known that, for supporting the drying and curing processes of printing inks and especially of varnishes, dryers may be disposed at or between printing units and in the delivery area. At the same time, large amounts of primary (infrared dryer) or secondary (UV dryer) heat are delivered to the materials to be printed and to the printing machine assembly adjacent to the dryers. The amount of heat, which is emitted by convection or radiation and not used for the drying process, is regarded as a disturbance for the printing process and the sheet delivery (adversely affects the printing in the subsequent printing machinery, excessively increases the stack temperature, damages thermally sensitive material to be printed) and, moreover, adversely affects the mode of functioning of adjacent machine elements in the event that these are overheated impermissibly. In addition, all materials (cables, hoses, tubes, sensors, pneumatic cylinders, etc.) in the range of action of the dryer must be extremely heat-resistant.

Additional cooling facilities are known to prevent overheating of printing machine elements in the dryer area and to cool material to be printed.

It is known to use an aspiration device to discharge heated air from the dryer area in the sheet delivery area. However, it does not cool sheet-guiding surfaces heated by radiation.

It is also known, for example from DE 19810387 C1, that baffles can be used for guiding sheets in an effective range of dryers, on the underside of which coolant channels are disposed. However, the cooling effect is limited only to the baffles and does not extend to the adjoining machinery parts or to the material to be printed.

It is known to use cooled compressed air for cooling printing plates, for example, from EP 0480230 A1. It is also disclosed in DE 4326835 A1 to cool cylinders by means of compressed air. The compressed-air cooling apparatus, as disclosed in EP 0480230 A1, has a combination of ventilators and controlled cooling apparatuses, which are only intended to cool printing plates and are constructed as a gap nozzle with a relatively low effective range. DE 4202544 A1 and DE 4326835 A1 disclose additional compressed air cooling beams with partial circulation of the cooling air for rubber blanket or plate cylinders, which are not suitable for guiding sheets.

Furthermore, WO 01/32423 A1 discloses cooling of printing and transfer cylinders heated by dryers, as well as the materials to be printed, which are indirectly heated by the dryers, with cooled, compressed air from cooling units, which have cooling registers and ventilators and are disposed in front of the printing zone.

It is a common disadvantage of all the compressed air cooling systems mentioned above that they require additional space, which makes access to the machinery assemblies more difficult during cleaning or setting-up activities. Furthermore, they are designed only for special cooling tasks. In general, the space along the traveling path of the sheets to be printed between dryers, sheet-guiding devices, washing devices or autoregister devices is not adequate for effective cooling of the heated machine elements and of the materials to be printed, which are exposed to the dryers.

SUMMARY OF THE INVENTION

It is an object of the present invention to provide an apparatus which requires little space and is able to cool effectively the material to be printed, as well as the machine elements, which are undesirably heated by the dryers.

Pursuant to the present invention, this objective is accomplished by providing an apparatus for cooling sheets to be printed and printing machine elements at a sheet-fed printing machine by means of cooled compressed air. The apparatus of the present invention comprises:

- at least one dryer;
- at least one pneumatic sheet-guiding device for guiding the sheets to be printed along a sheet-guiding path, said pneumatic sheet-guiding device being located in immediate vicinity of the sheet-guiding path; and
- at least one cooling device for supplying fresh air;
- wherein cooled compressed air passes over the at least one pneumatic sheet-guiding device for pneumatically guiding the sheets to be printed along the sheet-guiding path; and
- wherein the at least one cooling device is disposed in a cross section of a flow of the compressed air or in a sheet-guiding direction.

The apparatus of the present invention includes pneumatic sheet-guiding elements, present along the traveling path of the materials to be printed, such as sheets of paper, before and after the printing zone, below transfer drums and turning drums and in the delivery area by integrating at least one cooling device for generating and supplying cooled air to the materials to be printed, and compressed air flowing away therefrom for convective cooling of heated machine regions, so that the materials to be printed and the printing machine are cooled effectively along the whole path of the sheet. In comparison with having a central cooling device for several blowing devices, as disclosed in DE 09310028 U1 for blast boxes in the sheet delivery, the present invention has great advantages with respect to the space required, the controllability of the cooling output at each individual blowing device and also with respect to the cooling effect, since, on the one hand, any undesirable uptake of heat over the connecting air pipelines is prevented by integration of the cooling devices in the blowing device and, on the other hand, the amount of compressed air, which can be put through, is not limited by the cross section of the tube.

By supplying cooling air over the existing pneumatic sheet-guiding devices along the path of the sheets to be cooled, the present invention has the following advantages over the prior art wherein air is supplied exclusively over additional blowing devices above the transfer regions between the sheet-guiding cylinders:

- Construction expenditure is reduced by utilizing existing sheet-guiding devices.
- Cooling effect is improved due to the integration of cooling devices in the blast boxes below the transfer drums, thereby the air aspirated underneath the transfer cylinders is substantially cooler than the air aspirated above the printing cylinders by prior art cooling devices.

Because the compressed air cools over several sheet-guiding devices, the cooling air is distributed more uniformly over the printing machine area to be cooled The period of action and the amount of heat dissipated are increased about fourfold.

BRIEF DESCRIPTION OF THE DRAWINGS

Preferred embodiments of the present invention are explained in greater detail below by means of the drawings, in which.

DETAILED DESCRIPTION OF THE INVENTION

Figure 1:
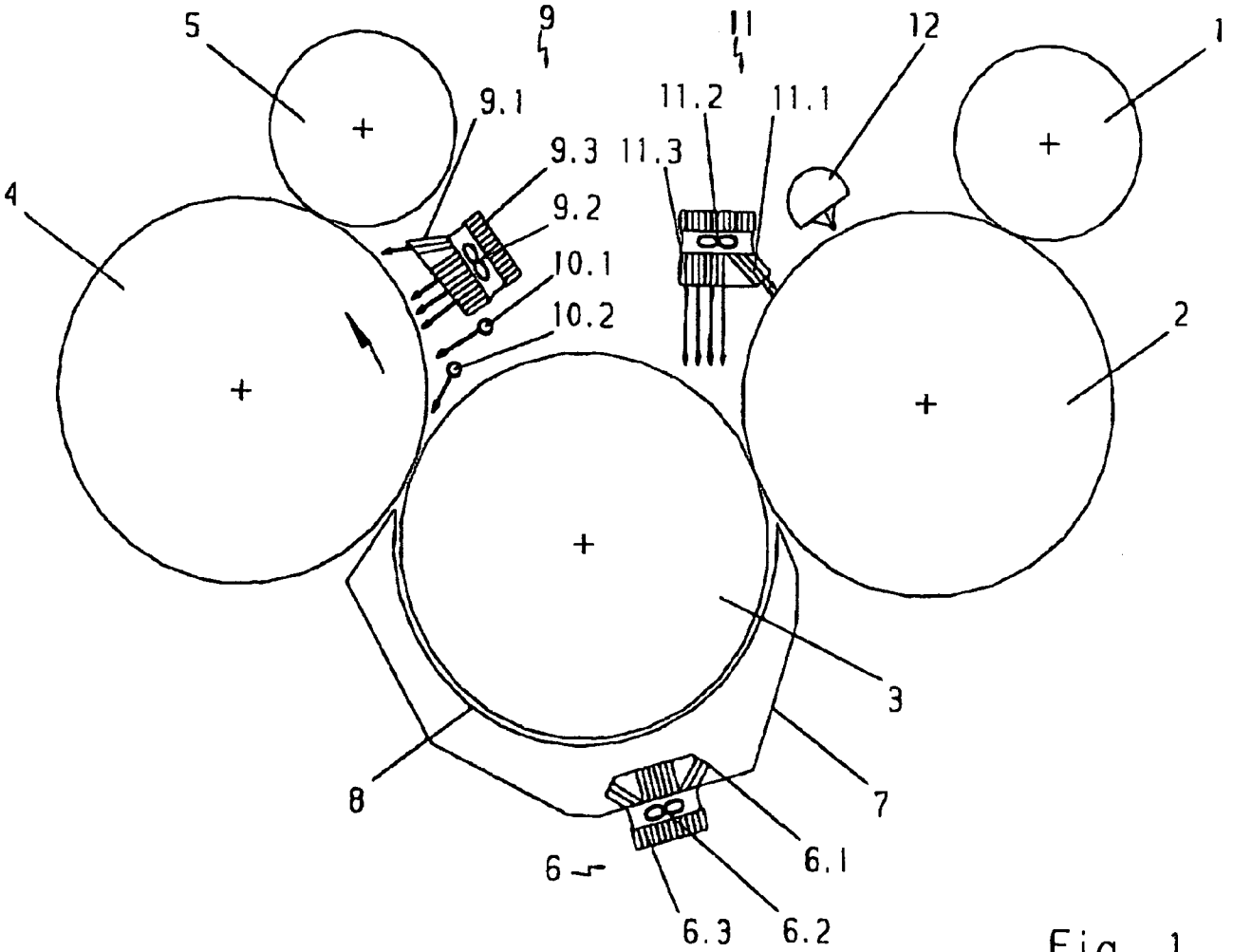
FIG. 1 shows pneumatic sheet-guiding devices with cooling devices in a section of a rotary sheet printing machine in side view.

In diagrammatic representation, FIG. 1 shows the sheet-guiding cylinders of two printing or varnishing units of a rotary sheet printing machine in in-line construction, between which there is a transfer drum 3. Of the printing units which are located upstream and downstream in the moving direction of the sheets, in each case only the printing cylinders 2, 4 and the rubber blanket cylinders 1, 5 interacting therewith, are shown. Depending upon the printing job and the machine configuration, pneumatic sheet-guiding devices, of which sheet-guiding devices 7, 9, 10, 11 are shown by way of example, are present along the moving path of the sheet.

Below the transfer drum 3, there is a well-known blast box 7, which prevents smearing of the printed sheet at an air cushion plate 8. Before the printing zone 4, 5 of the downstream printing unit, the sheet is placed smoothly against the printing cylinder 4 with the help of a blast box 9 and, depending on the thickness of the material to be printed, of additional air-nozzle pipes 10.1, 10.2.

If UV ink or a varnish is to be applied in an upstream printing unit, the sheet is dried with an intermediate dryer 12, which is disposed between the printing zone 1, 2 and the sheet-transfer region 2, 3. The dryer 12 is either an infrared or a UV dryer. It is known in the art that a compressed air cooling device 11 may be provided for cooling the sheet after it has passed through the dryer 12.

However, especially in the case of UV dryers, it is difficult to dry sheets effectively and to prevent the heating-up of the printing-machine region surrounding the dryer in this manner, especially the heating-up of the printing cylinder 2 and of the transfer drum 3. However, depending on the size and arrangement of the compressed air cooling device, the upstream rubber blanket cylinder 1 and the downstream printing cylinder 4 are also exposed to the heat radiating from the dryer 12

Pursuant to the present invention, for the purpose of cooling material to be printed and printing machine elements, at least one pneumatic sheet guiding device in the effective range of the dryers 12 and along the path of the sheets up to the sheet delivery area are equipped with a cooling device, the construction of which depends on the available space and on the nature of the sheet guiding device. The cooling device is disposed within the blast boxes in the suction and/or compressed air stream of ventilators or other pressure generators or assigned to the compressed air flowing from air nozzle pipes and constructed as a cooling register with cooling surfaces, through which a liquid may be flowing. The cooling medium may be water, brine or a gas, and the flow of the coolant can be controlled. If configured appropriately, the cooling surfaces can function, at the same time, as guiding surfaces for the desired guidance of the compressed air at the sheet-guiding device.

In a blast box 7 below the transfer drum 3, a cooling device 6.1 is disposed in the path of the compressed air coming from a ventilator 6.2, which supplies the air-cushion plate 8 with compressed air. Advantageously, the cooling surfaces may be constructed as lamellar air-guiding elements as shown in FIG. 1, which can distribute the compressed air from the ventilator 6.2 uniformly over the sheet-guiding plate and, at the same time, cool the flowing air. If the air cushion plate 8 is acted upon by several ventilators 6.2 or the blast box 7 is divided into several chambers with one or more ventilators in each chamber, a cooling device 6.1 may be assigned to each ventilator 6.2 in a modular fashion. These may also be combined with a coolant supplier and form a cycle.

If several ventilators 6.2 are arranged next to one another, the cooling surfaces may be arranged next to one another and parallel to the sheet-traveling direction. The outer contour of the cooling surfaces may conform to the shape of the blast box 7. Thus, a high cooling capacity can be achieved since the cooling surfaces may extend almost over the entire interior volume of the blast box 7.

Figure 2:
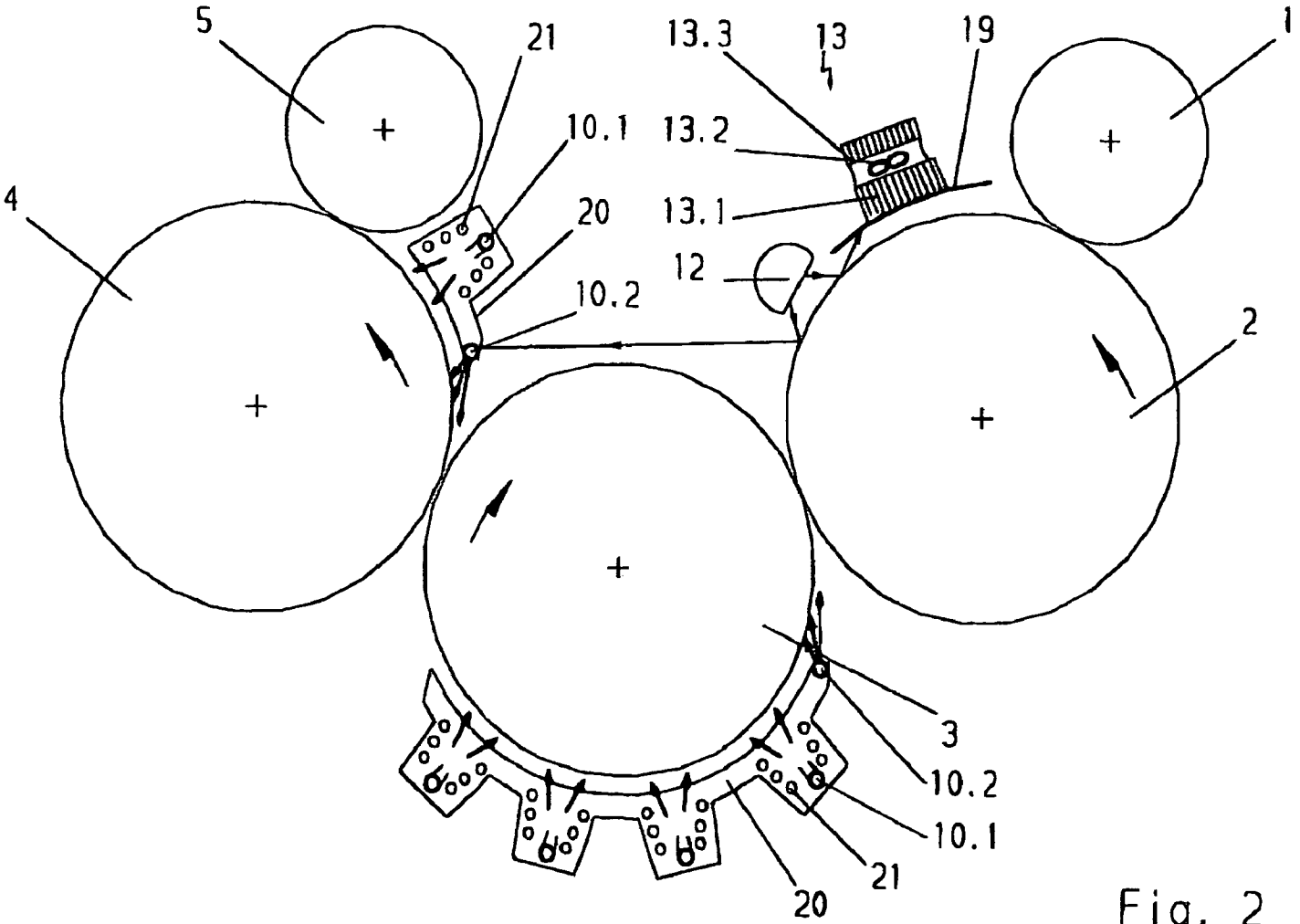
FIG. 2 shows an arrangement of a pneumatic sheet-guiding device with cooling devices after the printing zone.

In FIG. 2, cooling devices 20 assigned to air nozzle pipes 10.1, 10.2 have cooling surface rows with coolant ducts 21, which extend in the direction of the compressed air jet. The cooling surfaces, because of the little space usually available to the air nozzle pipes, are constructed compactly and shaped so that their contour corresponds to the path of the sheets. In a preferred embodiment, the cooling surfaces also serve to hold the air nozzle pipes 10.1, 10.2.

A guiding rod 19 is arranged in the effective range of the cooling surfaces for, for example, the sheet guiding device 13 after the printing zone 1,2, so that it has the advantage that no separate cooling system (as, for example, in DE 19829383) is necessary. Instead of the guiding rod, cooling surfaces of the cooling device 13.1 may extend along to the sheet traveling path.

Figure 3:
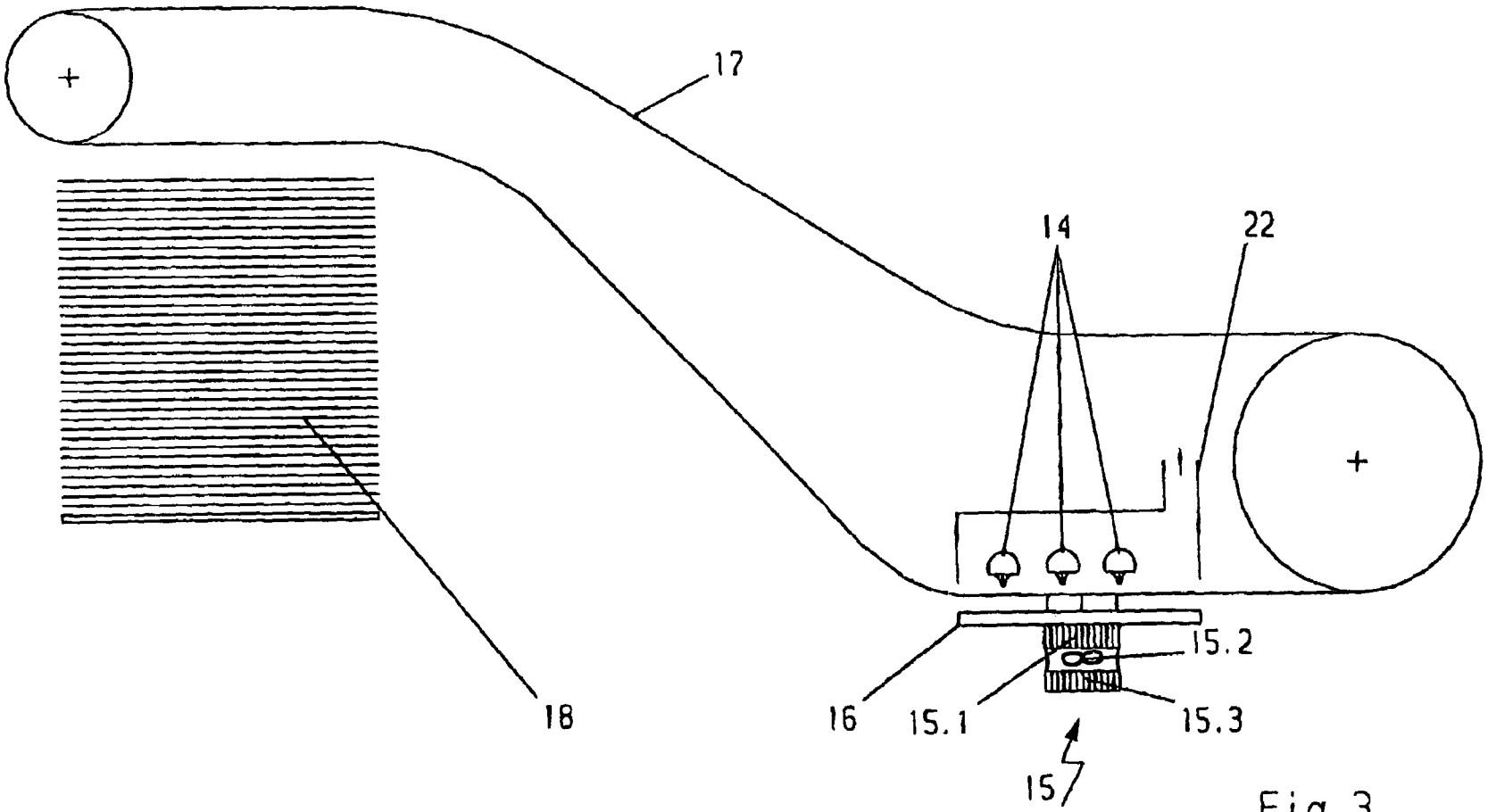
FIG. 3 shows an arrangement of a pneumatic sheet-guiding device with cooling devices in the sheet-receiving area.

As shown in FIG. 3, sheet-guiding devices 15, 16 are located in the delivery area in the dryer zone 14, which may be present in several modules. Similar to the blast box 7 shown in FIG. 1, the apparatus of the present invention has a cooling register 15.1 in the flow path of the compressed air which comes from the ventilator 15.2 and acts on the blast box 16. Several ventilators 15.2 and cooling registers 15.1 may be disposed in a row at appropriate angles to the transporting direction at the blast box 16.

To dissipate the warm air rising from the dryers 14 and to shield the surrounding printing-machine elements against heat radiated by the dryers 14, the dryers may be equipped with an exhaust device 22 above the path of the sheet.

The compressed air, cooled in the cooling devices 6.1, 9.1, 11.1, 13.1, 15.1 flows through the sheet-guiding devices and, initially, cools the guiding surfaces facing the sheet. The air cushion, produced outside of the sheet-guiding devices 6, 9, 11, 13, 15, cools the sheet and the drum or cylinder surface and thus protects the sheet against thermal deformation or damage. As the cooling air flows out of the sheet-guiding zone, the surrounding machine elements are additionally cooled convectively. The blast box 7 is particularly effective.

The apparatus cools the sheet very effectively and distributes the cooling air uniformly before it flows into the adjacent printing units for the purpose of temperature control. Compared to conventional compressed air cooling devices, the period of action and the cooling capacity can thus be increased by a factor of about 4.

Furthermore, the arrangement of the sheet-guiding devices 13, 20 may be selected in such a way, as shown in FIG. 2, that they shield the cylinder surfaces against thermal leakage radiating from the dryer and thus bring about an additional, secondary cooling effect.

What is claimed is:

1. An apparatus for cooling sheets to be printed and printing machine elements at a sheet-fed printing machine by means of cooled compressed air, said sheet-fed printing machine comprising:

at least one transfer drum, at least one printing cylinder;

a delivery area; and at least one dryer; said apparatus being an integrated pneumatic sheet-guiding and cooling assembly comprising:

at least one pneumatic sheet-guiding device, disposed in an effective range of said at least one dryer and along a sheet-guiding path, for pneumatically guiding the sheets to be printed along the sheet-guiding path, said at least one pneumatic sheet-guiding device being equipped with a device for supplying fresh compressed air for pneumatic sheet-guiding, and being located in immediate vicinity of said sheet-guiding path, at least one cooling device assigned to said device for supplying fresh compressed air, located in said integrated pneumatic sheet-guiding and cooling assembly for cooling a compressed air stream for pneumatic sheet-guiding, wherein said at least one cooling device is constructed as cooling surfaces in a cross section of said compressed air stream of said device for supplying fresh compressed air, and said cooling surfaces are constructed as a cooling register with lamellar air-guiding elements in a flow direction, through which a coolant flows.

2. The apparatus of claim 1, wherein said at least one pneumatic sheet-guiding device is a blast box and/or an air nozzle part.

3. The apparatus of claim 2, wherein the at least one cooling device is located in at least one blast box and/or at at least one air nozzle part below the at least one transfer drum or above the at least one printing cylinder.

4. The apparatus of claim 1, wherein the at least one device for supplying fresh compressed air are ventilators, air nozzle parts or other pressure generators.

5. The apparatus of claim 1, wherein said cooling surfaces are constructed as lamellar air-guiding elements at ventilators, which extend in a suction air stream of the ventilators or located in the inflowing compressed air jet being supplied into at least one blast box.

6. The apparatus of claim 5, wherein said cooling surfaces in said at least one blast box extend along the compressed air stream over the interior volume of the at least one blast box.

7. The apparatus of claim 5, wherein the cooling surfaces at said at least one air nozzle part are shaped so, that their contour corresponds to the path of the sheets.

8. The apparatus of claim 1, wherein said at least one cooling device is located in said at least one pneumatic sheet-guiding device in the delivery area.

9. The apparatus of claim 1, further comprising an additional sheet-guiding device with a cooling device, the additional sheet-guiding device being disposed for further cooling along the sheet-guiding path.

10. The apparatus of claim 1, further comprising an exhaust device for further cooling, said exhaust device being disposed above the at least one dryer.

11. The apparatus of claim 1, wherein said pneumatic sheet-guiding device is disposed between said at least one dryer and an upstream drying zone or before a subsequent printing zone in a propagation direction of reflected thermal radiation of said at least one dryer in such a manner that an upstream rubber sheet cylinder and a downstream printing cylinder are shielded from hear radiating from said at least one dryer.

12. An apparatus far cooling sheets to be printed and printing machine elements at a sheet-fed printing machine by means of cooled compressed air, said sheet-fed printing machine comprising:

at least one transfer drum, at least one printing cylinder;

a delivery area; and at least one dryer; said apparatus being an integrated pneumatic sheet-guiding and cooling assembly comprising:

at least one pneumatic sheet-guiding device disposed in an effective range of said at least one dryer and along a sheet-guiding path of the sheets, for pneumatically guiding the sheets to be printed along the sheet-guiding path, said at least one pneumatic sheet-guiding device being equipped with a device for supplying fresh compressed air for this purpose, and being located in immediate vicinity of the sheet-guiding path, at least one cooling device, assigned to said device for supplying fresh compressed air, located in said integrated pneumatic sheet-guiding and cooling assembly for cooling an air stream for pneumatic sheet-guiding, wherein said at least one cooling device is constructed as cooling surfaces in a cross section of an air stream of said device for supplying fresh compressed air, and the cooling surfaces are constructed as lamellar elements, through which a coolant flows, extending along the sheet guiding-path with a contour corresponding to the path of the sheets, designed as guiding rods.

* * * * *